US005421705A

United States Patent [19]

Benckert

[11] Patent Number: 5,421,705

[45] Date of Patent: Jun. 6, 1995

[54] OVERLOAD PROTECTIVE DEVICE FOR AN INTERNAL COMBUSTION ENGINE ACTING AS A DRIVE MOTOR OF A MAIN PUMP OF A HYDRAULIC PRESSURE GENERATOR

[75] Inventor: Hartmut Benckert, Filderstadt, Germany

[73] Assignee: Putzmeister-Werk Maschinenfabrik GmbH, Aichtal, Germany

[21] Appl. No.: 150,031

[22] PCT Filed: Feb. 27, 1992

[86] PCT No.: PCT/EP92/00424

§ 371 Date: Nov. 15, 1993

§ 102(e) Date: Nov. 15, 1993

[87] PCT Pub. No.: WO92/20921

PCT Pub. Date: Nov. 26, 1992

[30] Foreign Application Priority Data

May 14, 1991 [DE] Germany ..... 41 15 606.4

[51] Int. Cl.[6] ..... F04B 49/00

[52] U.S. Cl. ..... 417/218; 60/450

[58] Field of Search ..... 417/212, 218, 222.1; 60/450

[56] References Cited

U.S. PATENT DOCUMENTS

| | | | |
|---|---|---|---|
| 3,650,108 | 3/1972 | Isaac | 60/450 |
| 3,935,707 | 2/1976 | Murphy et al. | 417/218 |
| 3,947,194 | 3/1976 | Schlecht | 417/212 |
| 3,963,378 | 6/1976 | McMillan | 417/216 |
| 4,398,869 | 5/1983 | Kirkman et al. | 417/218 |
| 4,478,041 | 10/1983 | Pollman | 60/450 |
| 5,079,919 | 1/1992 | Nakamura et al. | 60/450 |
| 5,129,230 | 7/1992 | Izumi et al. | 60/450 |
| 5,326,230 | 7/1994 | Fischer | 417/218 |
| 5,355,676 | 10/1994 | Inokuchi | 60/450 |

FOREIGN PATENT DOCUMENTS

| | | |
|---|---|---|
| 2505780C2 | 7/1976 | Germany . |
| 2603563A1 | 7/1977 | Germany . |
| 3244615A1 | 6/1984 | Germany . |
| 3814824A1 | 11/1989 | Germany . |

OTHER PUBLICATIONS

"Die hydraulische Grenzlastregelung eines stufenlosen hydrostatischen Getriebes" by H. Hoffman, W. Koenig and D. Zeus; Konstruktion Dec. 1976, pp. 459–464.

*Primary Examiner*—Richard A. Bertsch
*Assistant Examiner*—Peter Korytnyk
*Attorney, Agent, or Firm*—Kenyon & Kenyon

[57] ABSTRACT

An overload protection device for a drive motor of a pressure generator is provided including an auxiliary pump, flow resistance devices, and a pressure-controlled valve. The drive motor drives the main pump of the pressure generator, whose output flow rate is stabilized by a hydraulic regulating valve, which senses the pressure of the output flow of the main pump. The auxiliary pump is also driven by the drive motor and generates an output flow rate proportional to the rotational speed of the drive motor. An auxiliary hydraulic circuit, including the first and second flow resistance devices connected in series, connects the auxiliary pump to the tank of the hydraulic pressure generator. The pressure-controlled valve includes a control chamber connected with a tapping point in the auxiliary hydraulic circuit for sensing the output flow of the auxiliary pump. The pressure-controlled valve is connected with the regulating valve of the hydraulic pressure generator such that if the rotational speed of the drive motor falls below a threshold value, the regulating valve is relieved of a comparison pressure from the main hydraulic circuit connected to the main pump, which will cause the delivery volume of the main pump to be reduced to a minimum delivery level, preventing the drive motor from being stalled.

15 Claims, 2 Drawing Sheets

OVERLOAD PROTECTIVE DEVICE FOR AN INTERNAL COMBUSTION ENGINE ACTING AS A DRIVE MOTOR OF A MAIN PUMP OF A HYDRAULIC PRESSURE GENERATOR

BACKGROUND OF THE INVENTION

A hydraulically driven thick-material delivery pump, e.g., a two-cylinder pump for concrete, includes delivery cylinders are each driven by a hydraulic drive cylinder, that by whose alternating pressurization with the outlet pressure from a hydraulic pressure generator and depressurization of said drive cylinders to the tank of the hydraulic pressure generator a continuous concrete supply is achieved. In the event of a drastic load variation due to malfunctions occurring in the area of the thick-material pump, in order to prevent stalling of, e.g., a load-sensing main pump of the hydraulic pressure generator regulated to a constant flow volume, it is known to detect the rotational speed of the diesel engine electronically and when this speed drops beneath a threshold value considered critical, to control through an electrohydraulic control device, the delivery volume adjusting element of the main pump of the hydraulic pressure generator to reduce the volume flow generated by the main pump. This reduces the pump's torque requirement to the point that it can still be supplied by the drive motor and stalling of the latter can be avoided.

This type of overload protection of the diesel engine and of the hydraulic pressure generator as a whole is, however, overly complex from a technical standpoint and too trouble-prone for the rough operating conditions under which thick-material pumps must often be operated. The goal of the invention therefore is to provide a protective device of the type recited at the outset which, though simple in design, provides reliable overload protection for the hydraulic pressure generator, and in particular prevents its drive motor from stalling.

The overload protection device for the drive motor in accordance with the invention includes an auxiliary pump, flow resistance devices, and a pressure-controlled valve. The drive motor drives the main pump of the pressure generator, whose output flow rate is stabilized by a hydraulic regulating valve, which senses a pressure drop across a choke in the main hydraulic circuit connected to the main pump. The hydraulic regulating valve adjusts the output flow of the main pump such that when the pressure drop across the choke increases, the output flow rate of the main pump is reduced and when the pressure drop across the choke decreases, the output flow rate of the main pump is increased.

The auxiliary pump is also driven by the drive motor and generates an output flow rate proportional to the rotational speed of the drive motor. An auxiliary hydraulic circuit, including the first and second flow resistance devices connected in series, connects the auxiliary pump to the tank of the hydraulic pressure generator. The auxiliary hydraulic circuit includes a tapping point at which flow pressure in the auxiliary hydraulic circuit may be sensed. The pressure-controlled valve includes a control chamber connected with the tapping point of the auxiliary hydraulic circuit. The pressure-controlled valve is connected with the regulating valve of the hydraulic pressure generator and to the main consumer circuit connected to the main pump of the pressure generator. The pressure-controlled valve is biased by a pretensioned valve spring into a basic position that causes the second control chamber of the regulating valve to be relieved of the comparison pressure in the main consumer circuit. By charging the control chamber of the pressure-controlled valve with pressure prevailing at the tapping point of the auxiliary hydraulic circuit, the pressure-controlled valve may be moved into a functional position in which the comparison pressure prevailing in the main consumer circuit may be applied to the second control chamber of the regulating valve. With the overload protection device, if the rotational speed of the drive motor falls below a threshold value, the output flow generated by the auxiliary pump will not hold the pressure-controlled valve in a functional position. The pressure-controlled valve will instead move to its basic position, causing the regulating valve to be relieved of the comparison pressure from the main hydraulic circuit. The delivery volume of the main pump will as a result be reduced to a minimum delivery level, preventing the drive motor from being stalled.

The overload protection device operates reliably and can be provided at a relatively low cost.

In accordance with one embodiment of the invention, the first flow resistance of the auxiliary hydraulic circuit is connected to a pressure outlet of the auxiliary pump, and the second flow resistance is adjustable and is connected between the first flow resistance and the tank of the hydraulic pressure generator for sensing the flow rate of the auxiliary pump. A simple control valve designed for use at low control pressure levels will suffice for use as the pressure-controlled valve.

In accordance with another embodiment of the invention, the second flow resistance of the auxiliary hydraulic circuit is adjustable and connected to a pressure outlet of the auxiliary pump and the first flow resistance is positioned in the auxiliary hydraulic circuit between second flow resistance and the tank of the hydraulic pressure generator. Although a valve designed for high control pressure levels may be required for the pressure-controlled valve, it may be integrated in the auxiliary pump, and provide more sensitive control.

In accordance with another embodiment of the invention, the pressure-controlled valve may comprise a differential valve.

In accordance with another embodiment of the invention, the pressure-controlled valve may be designed as a proportional valve.

In accordance with another embodiment of the invention, the pressure-controlled valve comprises a 3/3-way valve, which, between the basic position, in which the regulating valve is cut off from the comparison pressure in the main consumer circuit and is connected instead with the tank of the hydraulic pressure generator, and the functional position, in which the regulating valve is connected with the comparison pressure in the main consumer circuit but is cut off from the tank of the hydraulic pressure generator, the pressure controlled valve also has a blocking functional position, in which the regulating valve is cut off from both the comparison pressure of main consumer circuit and the tank of the hydraulic pressure generator. The pressure-controlled valve may include a valve body with switching positions in which the pressure-controlled valve moves from the blocking functional position to the basic position or alternately to the functional position, such that when looking in the displacement direction of the valve body, the switching positions are arranged at an interval from one another equal to between 1/50 and 1/5, preferably 1/10, of the total stroke that the valve body can execute between end positions corresponding to the functional or basic positions. With this arrangement, oscillations of the outlet flow from the main pump may be avoided at low rotational speeds of the drive motor.

In accordance with another embodiment of the invention, the first flow resistance of the auxiliary hydraulic circuit comprises a rotational-speed-synchronous consumer, and the pressure drop across the second flow resistance of the auxiliary hydraulic circuit is between 5% and 15%, preferably 10%, of the pressure drop developing across the rotational-speed-synchronous consumer during steady-state operation of main consumer circuit. This arrangement has been found to increase the energy efficiency of the device.

DETAILED DESCRIPTION

Figure 1:
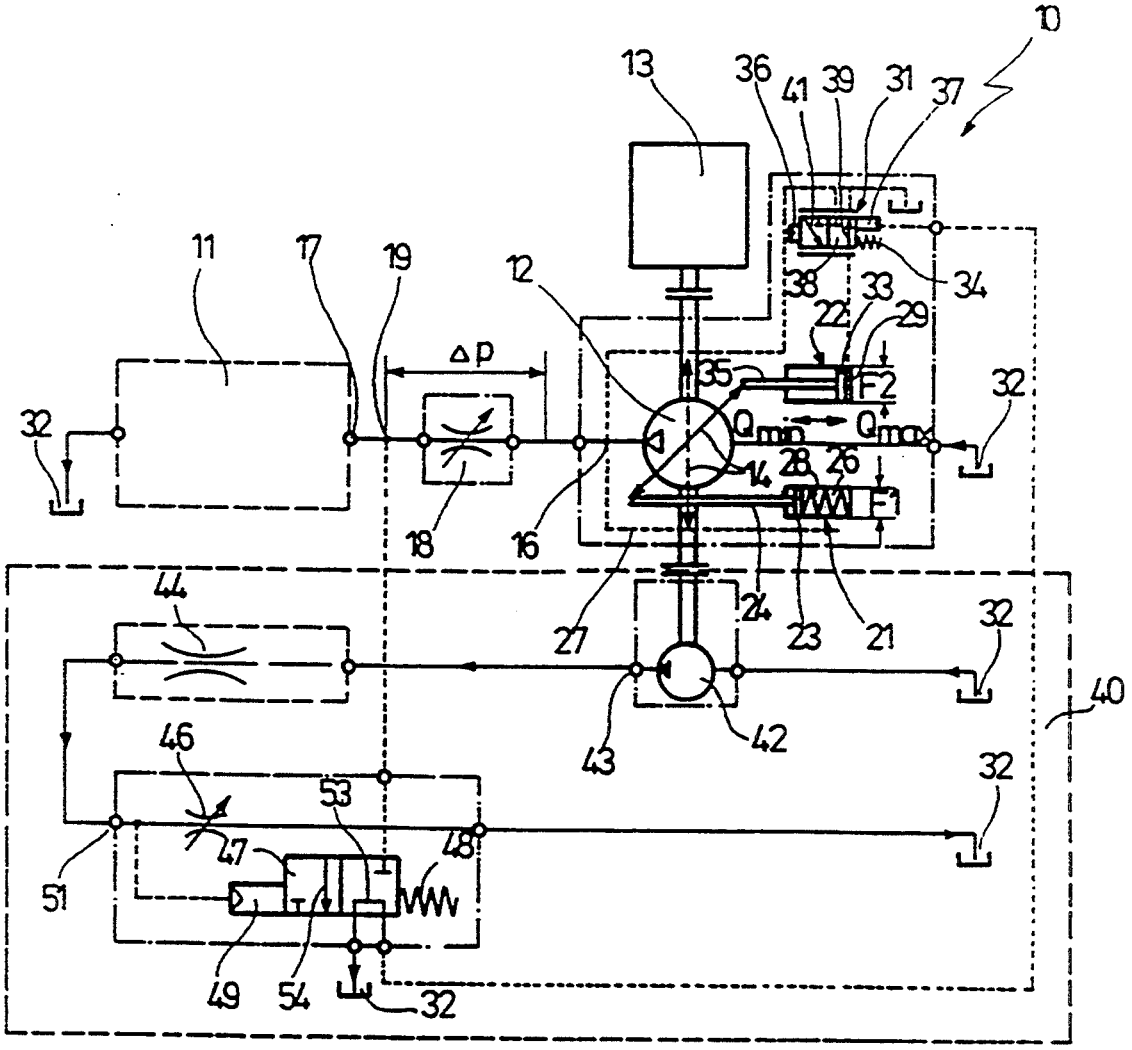
FIG. 1 is a schematic diagram of an overload protection device for the drive motor of a main pump of a hydraulic pressure generator in accordance with one embodiment of the invention.

The hydraulic pressure generator shown in FIG. 1 and represented as a whole by 10 for a consumer 11 indicated schematically, for example as a two-cylinder thick-material pump for conveying concrete, comprises a main pump 12, automatically adjustable with regard to its delivery volume per stroke or revolution, said pump being drivable by means of a diesel engine 13.

Main pump 12 is assumed to be a swash plate-axial piston pump, which is continuously adjustable to different delivery volumes by pivoting its swash plate, represented by double arrow 14, said values being adjustable between a minimum value $Q_{min}$ and a maximum value $Q_{max}$. The position of swash plate 14, indicated by the dashed lines and corresponding to minimum delivery volume, is the one in which its normal line runs parallel to the axes of the axial piston pump elements, not shown. In the position corresponding to maximum delivery volume $Q_{max}$ of swash plate 14, its normal line runs for example at an angle of 30° to the central axes of the axial piston pump elements.

A choke 18 with adjustable flow resistance is connected as a load sensing element between high pressure outlet 16 of main pump 12 and high pressure supply connection 17, across which choke, during operation of hydraulic pressure generator 10 and consumer 11, a pressure drop $\Delta P$ appears, representing the difference by which the effective supply pressure $P_V$ tappable at central tap 19 between choke 18 and high pressure supply connection 17 of consumer 11, is lower than the outlet pressure $P_H$ of main pump 12 at its high pressure outlet 16.

In the course of delivery volume regulation of main pump 12, its swash plate 14 is adjustable to various pivot positions, in the special embodiment shown, two linear cylinders 21 and 22, as actuating drives, are provided by means of which oppositely directed moments are exertable on swash plate 14 from whose equilibrium the respective pivot positions of swash plate 14 and the delivery volume of main pump 12 linked to said equilibrium result.

Drive pressure chamber 26, axially movably delimited by a piston 23 which through piston rod 24 is linked to swash plate 14, of that linear cylinder 21, by whose pressurization swash plate 14 is pivoted to increase the delivery volume of main pump 12, is permanently connected by a control line 27 with high pressure outlet 16 of main pump 12. Both through the resultant application of the output pressure of main pump 12 to the drive pressure chamber 26 and also through a pretensioned compression spring 28, linear cylinder 21 constantly delivers a force resulting in a moment that urges swash plate 14 into a position corresponding to its maximum delivery volume.

Drive pressure chamber 29 of second linear cylinder 22, by whose pressurization a moment can be generated that urges swash plate 14 into the pivot position corresponding to its minimum delivery volume, is connectable through a control valve 31, controlled by pressure and acting as a manometric balance, alternately to (pressureless) tank 32 of hydraulic pressure generator 10 or to high pressure outlet 16 of main pump 12.

Due to the linked connection of piston rod 35 of piston 33 forming the axially movable limit of driving pressure chamber 29 of the second linear cylinder, to the swash plate 14 of main pump 12, pretensioned compression spring 28 of first linear cylinder 21 also acts as the return spring for second linear cylinder 22, urging its piston 33 into the basic position corresponding to the minimum volume of its drive pressure chamber 29.

Regulating valve 31 is designed as a 3/2-way valve, and is urged by a valve spring 34 into the basic position 0 shown, in which drive pressure chamber 29 of second linear cylinder 22 is connected with pressureless tank 32 of the hydraulic pressure generator and is cut off from high pressure outlet 16 of main pump 12. By pressurizing a first control chamber 36 of regulating valve 31 with a high outlet pressure $P_H$ from main pump 12, regulating valve 31 is urgeable into its functional position I alternative to basic position 0, in which drive pressure chamber 29 of the second linear cylinder is connected with high pressure outlet 16 of main pump 12 and is also cut off from pressureless tank 32 of hydraulic pressure generator 10.

By pressurizing a second control chamber 37 of regulating valve 31 with pressure $P_V$ at center tap 19 between choke 18 and consumer 11, said pressure being decreased slightly from the high outlet pressure $P_H$ of main pump 12, regulating valve 31 is urged into its basic position 0.

Regulating valve 31 is designed as a proportional valve, in which increasing deflection of its valve piston, represented by switch symbol 38, from its initial spring-centered end position as basic position 0, initially decreases the throughput cross section of through flow path 39 connecting drive pressure chamber 29 of the second linear cylinder with tank 32 until the path is blocked and a further deflection of valve piston 38, leading to assumption of functional position I, results in an increasing, i.e., a cross-section-increasing of the opening of through flow path 41, by which drive pressure chamber 29 of second linear cylinder 22 is connected with high pressure outlet 16 of main pump 12 in functional position I.

Hydraulic pressure generator 10, which has been explained in terms of its design, operates when, and as long as, central tap 19 between choke 18 and consumer 11 is connected with second control chamber 37 of regulating valve 31 as follows:

Before diesel engine 13 is switched on and hence prior to activation of hydraulic pressure generator 10 and beginning of operation of consumer 11, connected between adjustable choke 18 and tank 32 of hydraulic pressure generator 10, the two linear cylinders 21 and 22 are in their basic positions as shown, corresponding to the maximum delivery volume of main pump 12, and piston 38 of regulating valve 31 assumes its spring-centered end position corresponding to maximum throughput cross section of through flow path 39, corresponding in turn to the basic position 0 of regulating valve 31.

When diesel engine 13 is switched on, along with the initial activation of main pump 12 linked therewith, as the flowrate of the oil stream delivered by main pump 12 through choke 18 and consumer 11 rises, pressure $P_H$ at the high pressure outlet of the main pump and also at middle tap 19 across choke 11 also rises, with pressure differential $\Delta P$, the pressure drop across choke 18, likewise increasing between high pressure outlet 16 of main pump 12 and center tap 19 and/or high pressure supply connection 17 of consumer 11.

As the outlet pressure $P_H$ develops at high pressure outlet 16 of main pump 12, and as soon as the pressure in first control chamber 36 of regulating valve 31 is sufficient to displace its piston 38 into its functional position I against the relatively low restoring force of valve spring 34, the pressure in drive pressure chamber 29 of second linear cylinder 22 provided to adjust swash plate 14 increases. The effective cross sectional area $F_2$ of piston 33 of this second linear cylinder 22 is somewhat larger than the effective cross sectional area $F_1$ of first drive cylinder 21, with whose drive pressure chamber 28 the output pressure developing at high pressure outlet 16 of main pump 12 is permanently coupled. The amount $\Delta F$ by which the effective cross sectional area $F_2$ of piston 33 of second linear cylinder 22 is larger than the effective cross sectional area $F_1$ of first linear cylinder 21 is set so that even at relatively low outlet pressures of main pump 12, for example 6 to 12 bars, the force developed by second linear cylinder 22 is sufficient to "overpressurize" first linear cylinder 21 and rotate swash plate 14 into the position corresponding to the minimum delivery volume of main pump 12. As a result, in the initial phase of activation of hydraulic pressure generator 10, the torque requirement of main pump 12 is reduced, lowering the load on drive motor 13 and allowing it to reach its required rotational speed.

With a steadily increasing flow volume through choke 18 and consumer 11, pressure $P_V$, tapped off at center tap 19 between choke 18 and consumer 17, coupled to second control chamber 37 of regulating valve 31, rises, whereupon the regulating valve, with the aid of its valve spring 34, again returns to its basic position 0 in which drive pressure chamber 29 of second linear cylinder 22 communicates with supply chamber 32, causing swash plate 14 to pivot, increasing the flow volume delivered by main pump 12. In the stationary state of the flow volume regulation, the regulating device comprising regulating valve 31, linear cylinders 21 and 22 acting on swash plate 14 of main pump 12, and choke 18 connected between main pump 12 and consumer 11 stabilizes the oil flow through choke 18 and consumer 11 to tank 32 of hydraulic pressure generator 10 at a level that can be set indirectly by the adjustable pretensioning of valve spring 34 of regulating valve 31. Thus it is immaterial over a broad adjustment range of choke 18 what its flow resistance is set to.

In addition to the regulating device provided within the framework of hydraulic pressure generator 10, which stabilizes the flow volume generated by main pump 12 at a desired value, even when the load represented by consumer 11 is subject to considerable fluctuation, a protective device is provided, designated as a whole by 40 which, when the output torque of diesel engine 13 is no longer sufficient to drive main pump 12 to maintain a predetermined outlet flow volume, reliably prevents diesel engine 13 from stalling, which could lead to serious operating problems.

An emergency situation of this kind can arise as a result of a malfunction of consumer 11, but can also occur under control, for example when choke 18 is automatically adjusted for increased flow resistance in the end phases of such strokes in order to reverse the piston movements of consumer 11 gently.

Protective device 40 comprises an auxiliary pump 42, driven like main pump 12 by diesel engine 13 and generating a flow volume proportional to the rotational speed of diesel engine 13. Between pressure outlet 43 and supply container 32 of hydraulic pressure generator 10 is a hydraulic series circuit consisting of a consumer 44, represented by a fixed choke, and of an adjustable choke 46 across which outlet pressure $P_A$ of auxiliary pump 42 drops, with the pressure drops $\Delta P_V$ and $\Delta P_D$ appearing across the components of this series circuit, consumer 44, and adjustable choke 46 being proportional to the flow resistances of consumer 44 and adjustable choke 46, and together determining output pressure $P_A$ of auxiliary pump 42. The consumer 44 may comprise a rotational-speed-synchronous consumer like a hydraulically driven mixer.

In the embodiment shown in FIG. 1, in which consumer 44 is connected directly to high pressure outlet 43 of auxiliary pump 42 and adjustable choke 46 is connected between consumer 44 and tank 32, protective device 40 comprises a control valve in the form of a 3/2-way valve, designed as a pressure-controlled valve, urged into its basic position 0 by a pretensioned valve spring 48, in which position second control chamber 37 of pressure-controlled regulating valve 31 of hydraulic pressure generator 10 is connected with tank 32 of hydraulic pressure generator 10, said control chamber 37 being cut off from center tap 19 between choke 18 and consumer 11, and urgeable into its functional position I by pressurization of control chamber 49 with the pressure prevailing between consumer 44 connected to auxiliary pump 42 and adjustable choke 46, the level of said pressure corresponding to pressure drop $\Delta P_D$ across adjustable choke 46, in which position the pressure prevailing at center tap 19 between adjusting choke 18, serving as a load sensing element, and consumer 11 is coupled to second control chamber 37 of regulating valve 31, said chamber 37 being cut off from tank 32 of hydraulic pressure generator 10.

The protective device described above operates as follows:

As long as the rotational speed of diesel engine 13 is higher than a presettable threshold value, above which stalling of diesel engine 13 can be ruled out with sufficient reliability, the pressure drop across adjustable choke 46 of protective device 40 and hence the pressure coupled with control chamber 49 of control valve 47 is sufficient to hold control valve 47 in its functional position I against the action of valve spring 48, in which position the pressure applied to center tap 19 of the main pump circuit is coupled to second control chamber 37 of regulating valve 31 and hydraulic pressure generator 10 operates in the normal, load-sensing regulating fashion.

If the rotational speed of diesel engine 13 drops below the above-mentioned threshold value, so that the flow volume generated by auxiliary pump 42 no longer suffices to hold control valve 47 in its functional position I by the pressure prevailing between consumer 44 and adjustable choke 46 of protective device 40, so that the valve is moved to its basic position 0 by the restoring force of valve spring 48, second control chamber 37 of regulating valve 31 discharges its pressure into tank 32 of hydraulic pressure generator 10, whereupon main pump 12 is brought to the functional state corresponding to its minimum delivery volume and hence to its minimum torque requirement, at which diesel engine 13 can no longer be stalled.

A drop below the rotational speed threshold value that causes control valve 47 to move from its functional position I corresponding to normal regulating operation into its basic position 0 to protect diesel engine 13 from stalling can be preset by setting a given flow resistance on adjustable choke 46. In a typical design of protective device 40, the control pressure above which control valve 47 switches to its functional position I is between 4 and 10 bars.

Figure 2:
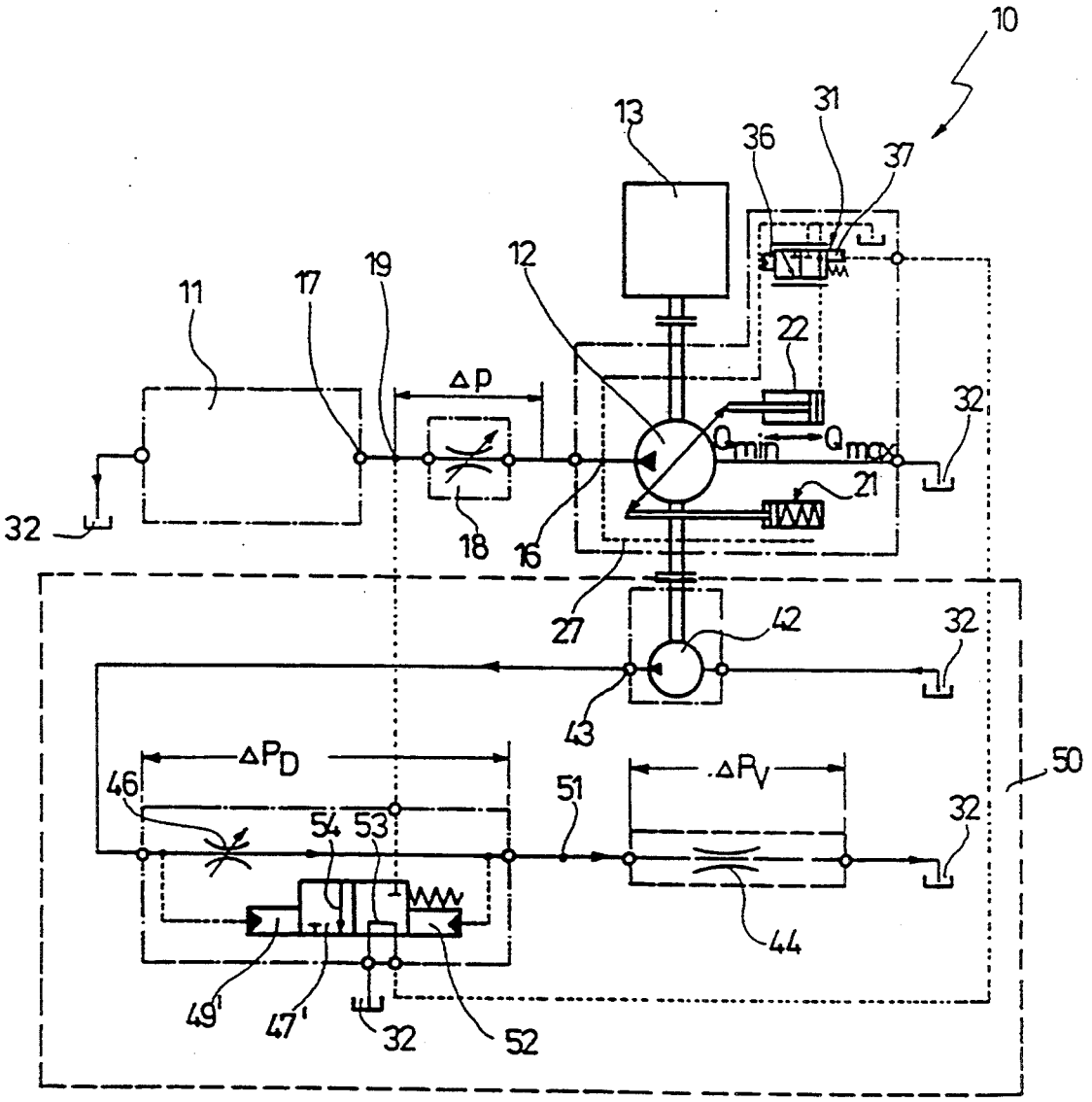
FIG. 2 is a schematic diagram of an overload protection device for the drive motor of a main pump of a hydraulic pressure generator in accordance with another embodiment of the invention.

Protective device 50 shown in FIG. 2 is functionally equivalent to protective device 40 shown in FIG. 1, but differs from it in its circuit design, namely adjustable choke 46, used to set the rotational speed threshold below which second control chamber 37 of regulating valve 31 is relieved of pressure and is connected directly to high pressure outlet 43 of auxiliary pump 42, and in that consumer 44 is connected between this adjustable choke 46 and tank 32 of the hydraulic pressure generator, and further in that control valve 47', which in its basic position 0 and its alternate functional position I performs the same functions as control valve 47 of protective device 40 as shown in FIG. 1, is designed here as a differential valve that switches from its basic position 0 to its functional position I when pressure differential $\Delta P_D$ between high pressure outlet 43 of auxiliary pump 42 and center tap 51 between adjustable choke 46 and consumer 44 exceeds a threshold value which can be the same as the control pressure that develops in the embodiment shown in FIG. 1 across adjustable choke 46 connected between consumer 44 and tank 32.

Accordingly, in control valve 47' of protective device 50 as shown in FIG. 2, in addition to first control chamber 49' pressurized with the outlet pressure provided at high pressure outlet 43 of auxiliary pump 42, urging control valve 47' into its functional position I, a second control chamber 52 is provided, pressurized by the pressure prevailing at center tap 51 between adjustable choke 46 and consumer 44, whereupon control valve 47' is urged into its basic position 0, control chambers 49' and 52 being designed so that the forces resulting from their pressurization and action in opposite directions on the valve pistons cease, so that in this control valve 47' the pressure level is determined by pressurization of its second control chamber 52, relative to which the pressure coupled to first control chamber 49' must be higher so that control valve 47' can be switched against the action of valve spring 48 to its functional position I. Control valve 47' is also designed so that this pressure differential amounts to only a few bars, 6 bars for example.

In the embodiment of protective device 50 according to FIG. 2, control chambers 49' and 52 of control valve 47' are exposed, in absolute terms, to much higher pressures than control chamber 49 of control valve 47 of protective device 40 according to FIG. 1, imposing stricter requirements on the tightness of control chambers 49 and 52. In protective device 50 according to FIG. 2, however, it is quite possible to combine control valve 47' and adjustable choke 46 structurally with auxiliary pump 42 in an integral design, since consumer 44 is connected hydraulically downstream from this hydraulic functional unit.

Both in protective device 40 as shown in FIG. 1 and in protective device 50 shown in FIG. 2, control valve 47 or 47' can be designed as a proportional valve, which, following a transition from one of the possible functional positions, 0 or I, to the other, exposes increasing opening cross sections of effective bypass and/or through flow paths 53 and 54, providing for especially gentle and therefore protective accelerating and decelerating characteristics of main pump 12 when switching consumer 11 in the main circuit.

In such a design of control valve 47 or 47', the latter, as is not shown in particular, can be designed as a 3/3-way valve, connected between a functional position 0 in which second control chamber 37 of regulating valve 31 is cut off from comparison pressure tapping point 19 of main consumer circuit 11, 18, and therefore is connected with tank 32 of hydraulic pressure generator 10, and functional position I, in which second control chamber 37 of regulating valve 31 is connected with comparison pressure tapping point 19 of the main consumer circuit, but is cut off from the tank of hydraulic pressure generator 10, and has a blocking functional position II, in which second control chamber 37 of regulating valve 31 is cut off both from comparison pressure tapping point 19 of main consumer circuit 11, 18 and also from tank 32 of hydraulic pressure generator 10.

In a special design of such a 3/3-way valve, the switching positions in which the control valve moves from its blocking functional position II into its through flow position 0 or alternatively through flow position I, looking in the displacement direction of the valve body, are arranged at a distance from one another that represents between 1/50 and 1/5, preferably 1/10, of the total stroke that the valve body can execute between its end positions associated with alternate through flow functional positions 0 and I.

What is claimed is:

1. An overload protection device for a drive motor of a main pump of a hydraulic pressure generator, the main pump including a high pressure outlet for an output flow of a medium, wherein a hydraulic regulating device is provided for stabilizing the output flow rate of the main pump and wherein a main consumer circuit is connected to the high pressure outlet, said main consumer circuit including a choke and a main consumer connected in series and leading to a tank such that a pressure drop occurs in the consumer circuit across the choke indicative of the output flow rate of the main pump, wherein an outlet pressure ($P_H$) of the main pump may be tapped at a first tapping point in the main consumer circuit at the outlet of the main pump and a comparison pressure ($P_V$) in the main consumer circuit between the choke and the main consumer may be tapped at a second tapping point between the choke and the main consumer, and wherein the regulating device includes a regulating valve for sensing said pressure drop by comparing the outlet pressure ($P_H$) and the comparison pressure ($P_V$), the regulating valve having first and second control chambers, the first chamber being connected to the first tapping point and the second chamber being connected to the second tapping point, the regulating valve being capable of adjusting a hydraulic positioning device in the main pump to change the output flow rate of the main pump such that when the pressure drop across the choke increases, the output flow rate of the main pump is reduced and when the pressure drop across the choke decreases, the output flow rate of the main pump is increased, said overload protection device, comprising:

an auxiliary pump driven by the drive motor for generating an output flow having a flow rate proportional to the rotational speed of the drive motor;

an auxiliary hydraulic circuit connecting said auxiliary pump to said tank, said auxiliary hydraulic circuit including therein a first flow resistance device and a second flow resistance device connected in series, and a tapping point at which flow pressure in the auxiliary hydraulic circuit may be sensed; and a pressure-controlled valve including a control chamber connected with said tapping point of said auxiliary hydraulic circuit, said pressure-controlled valve being connected with said regulating valve and said main consumer circuit and being biased by a pretensioned valve spring into a basic position which causes the second control chamber of the regulating valve to be relieved of the comparison pressure ($P_V$) and wherein by charging the control chamber of the pressure-controlled valve with pressure prevailing at the tapping point of the auxiliary hydraulic circuit, the pressure-controlled valve may be moved into a functional position in which comparison pressure ($P_V$) prevailing in the main consumer circuit may be applied to the second control chamber of the regulating valve.

2. The overload protection device of claim 1, wherein the first flow resistance device in the auxiliary hydraulic circuit comprises a rotational-speed-synchronous consumer.

3. The overload protection device of claim 2, wherein the rotational-speed-synchronous consumer comprises a hydraulically driven mixer.

4. The overload protection device of claim 1, wherein the first flow resistance of the auxiliary hydraulic circuit is connected to a pressure outlet of the auxiliary pump, and wherein said second flow resistance is adjustable and is connected between the first flow resistance and the tank of the hydraulic pressure generator for sensing the flow rate of the auxiliary pump.

5. The overload protection device of claim 1, wherein the second flow resistance of the auxiliary hydraulic circuit is adjustable and connected to a pressure outlet of the auxiliary pump and wherein the first flow resistance is positioned in the auxiliary hydraulic circuit between second flow resistance and the tank of the hydraulic pressure generator.

6. The overload protection device of claim 5, wherein the pressure-controlled valve provided for coupling the comparison pressure ($P_V$) with the second control chamber of the regulating valve comprises a differential valve and, when the control chamber of the pressure-controlled valve is pressurized with the outlet pressure of the auxiliary pump, the pressure-controlled valve is urged into a functional position whereby the comparison pressure ($P_V$) is applied to the second control chamber of the regulating valve, and when a second control chamber of the pressure-controlled valve is pressurized, is urgeable into the basic position wherein the second control chamber of the regulating valve is relieved of the comparison pressure ($P_V$).

7. The overload protection device of claim 1, wherein the pressure-controlled valve includes flow paths for the alternate functional and basic positions, wherein cross sections of said flow paths expand with increasing deflection of the valve body.

8. The overload protection device of claim 1, wherein the pressure-controlled valve comprises a 3/3-way valve, which, between the basic position, in which the second control chamber of the regulating valve is cut off from the second tapping point in the main consumer circuit and is connected instead with the tank of the hydraulic pressure generator, and the functional position, in which the second control chamber of the regulating valve is connected with the second tapping point of the main consumer circuit but is cut off from the tank of the hydraulic pressure generator, said pressure-controlled valve has a blocking functional position, in which the second control chamber of the regulating valve is cut off from both the second tapping point of the main consumer circuit and the tank of the hydraulic pressure generator.

9. The overload protection device of claim 8, wherein the pressure-controlled valve includes a valve body with switching positions in which the pressure-controlled valve moves from the blocking functional position to the basic position, and wherein looking in the displacement direction of the valve body, the switching positions are arranged at an interval from one another equal to between 1/50 and 1/5, of the total stroke that the valve body can execute between end positions corresponding to the functional or basic positions.

10. The overload protection device of claim 8, wherein the pressure-controlled valve includes a valve body with switching positions in which the pressure-controlled valve moves from the blocking functional position to the functional position, and wherein looking in the displacement direction of the valve body, the switching positions are arranged at an interval from one another equal to between 1/50 and 1/5 of the total stroke that the valve body can execute between end positions corresponding to the functional or basic positions.

11. The overload protection device of claim 8, wherein the pressure-controlled valve includes a valve body with switching positions in which the pressure-controlled valve moves from the blocking functional position to the basic position, and wherein looking in the displacement direction of the valve body, the switching positions are arranged at an interval from one another equal to approximately 1/10 of the total stroke that the valve body can execute between end positions corresponding to the functional or basic positions.

12. The overload protection device of claim 1, wherein the first flow resistance of the auxiliary hydraulic circuit comprises a rotational-speed-synchronous consumer, wherein the pressure drop across the second flow resistance of the auxiliary hydraulic circuit is between 5% and 15 % of the pressure drop developing across rotational-speed-synchronous consumer during steady-state operation of main consumer circuit.

13. The overload protection device of claim 1, wherein the drive motor comprises an internal combustion engine.

14. The overload protection device of claim 13, wherein the drive motor comprises a diesel engine.

15. The overload protection device of claim 1, wherein the first flow resistance of the auxiliary hydraulic circuit comprises a rotational-speed-synchronous consumer, wherein the pressure drop across the second flow resistance of the auxiliary hydraulic circuit is approximately 10% of the pressure drop developing across rotational-speed-synchronous consumer during steady-state operation of main consumer circuit.

* * * * *